United States Patent [19]

Grigsby et al.

[11] Patent Number: 4,702,016

[45] Date of Patent: Oct. 27, 1987

[54] APPARATUS FOR DRYING SHOES IN A DRYER

[76] Inventors: Samuel H. Grigsby; Beverly A. Grigsby, both of Rte. 11, Box 250, London, Ky. 40741-8416

[21] Appl. No.: 902,434

[22] Filed: Aug. 29, 1986

[51] Int. Cl.[4] ..... F26B 3/04; F26B 11/04

[52] U.S. Cl. ..... 34/33; 34/104; 34/106; 34/133; 211/35

[58] Field of Search ..... 34/104, 106, 133, 151; 211/35; 248/205.1, 206.5

[56] References Cited

U.S. PATENT DOCUMENTS

| | | | |
|---|---|---|---|
| 3,256,616 | 6/1966 | McGoldrick | 34/104 |
| 3,287,820 | 11/1966 | Gibson | 34/151 |
| 3,724,095 | 4/1973 | Lane et al. | 34/133 |
| 4,109,397 | 8/1978 | Daily | 34/133 |
| 4,530,168 | 7/1985 | Petre | 34/106 |

*Primary Examiner*—Albert J. Makay
*Assistant Examiner*—David W. Westphal
*Attorney, Agent, or Firm*—King & Schickli

[57] ABSTRACT

An apparatus for drying shoes in a clothes dryer includes a frame member having a mounting surface for receiving and supporting a shoe. Fasteners, in the form of a pair of straps, may be adjusted to securely engage and hold the shoe on the mounting surface. Lips provided at each end of the mounting surface help prevent the shoe from slipping from the surface. A powerful magnet allows the secure attachment of the apparatus and shoe to the drum of an automatic dryer. Preferably the apparatus is mounted to the metal wall of the drum directly behind a paddle of the drum that serves to tumble clothes in the dryer as the drum rotates. The magnet is securely mounted to the frame member in a channel. The channel is formed of ferromagnetic material, and the sidewalls of the channel extend past the engaging face of the magnet. These sidewalls then act as dipoles to concentrate the attractive force of the magnet for more secure attachment of the apparatus to the dryer drum.

21 Claims, 5 Drawing Figures

APPARATUS FOR DRYING SHOES IN A DRYER

BACKGROUND OF THE INVENTION

The present invention relates generally to the drying of shoes and, more particularly, to an accessory for an automatic clothes dryer that allows the tumble free drying of shoes without adversely affecting the tumbling action and, therefore, the effective drying of other clothes in the dryer.

It is not uncommon for shoes to become wet. This may occur, for example, when it rains unexpectedly and an individual must walk across wet ground and/or through wet grass to reach his desired destination. Athletic shoes in particular may also become sweaty and dirty and need washing to restore their appearance and eliminate undesirable odors. Since the wearing of wet shoes is neither comfortable nor healthy it is, of course, desirable to dry the shoes before they are worn again.

The drying of wet shoes may be accomplished in a number of different ways. The shoes may simply be exposed to the ambient atmosphere. This prevents damage to the shoes from excessive heat but it may require 24 hours or more to complete the drying process depending on humidity and temperature levels. As such, where the shoes need to be dried quickly so as to be available for wear within a shorter time, an alternative drying approach must be used.

To achieve more rapid drying some individuals have resorted to placing the shoes in an oven. It should be appreciated, however, that an oven is not designed to dry shoes. Even on a relatively low temperature setting, the element that heats the oven may become sufficiently hot to cause the shoes to shrink or warp and possibly even melt the soles of the shoes to the oven rack. Should the shrinking or warping of the shoes reach a critical degree the shoes become too uncomfortable to be worn again. Where the soles actually melt, their resulting configuration may make the shoes unsightly, as well as making them uncomfortable to wear. As such, the drying of shoes in an oven is a completely unsatisfactory approach.

The shoes could also be cycled through an automatic clothes dryer so as to rapidly dry the shoes for wear in a relatively short time. While a dryer does effectively dry the shoes without causing any real damage as described above with respect to an oven, this method is not without its disadvantages. Specifically, conventional automatic dryers include a rotating metal dryer drum. The drum includes a series of radially extending paddles on its inner circumferential surface to tumble the clothes being dryed. This tumbling exposes the greatest surface area of the clothes to the drying air currents passing through the drum so as to improve overall drying effectiveness and efficiency.

The rotating and tumbling action produced by the dryer is effective for drying clothes but is inappropriate for drying shoes. The shoes in a dryer are essentially tossed back and forth in the drying drum. As the shoes bounce against the wall of the drum disconcerting and annoying banging noises are produced. The shoes may also become damaged by scuffing against each other or the paddles or wall of the drum. Further, where heavy shoes, such as hightopped basketball sneakers or hiking shoes are being dryed, the shoes may even damage the paddles or drum of the dryer by denting the metal material. In the event the dryer drum is bent and becomes out-of-round anywhere along the track that is used to guide the rotating drum, dryer operation may become impaired. Any resulting deformations in drum track could cause excessive wear in the guide bearings that are received in the track and support the drum during rotation. Thus, costly repair and perhaps replacement of the bearings or the drum itself results. Thus, it should be appreciated that this approach is also unsatisfactory.

Still, the suitability of an automatic dryer to dry shoes through the provision of circulating, drying air should not go unappreciated. It is only the tumbling action created in a dryer that leads to the problems discussed above. Recognizing this, methods and apparatus have been developed for drying articles within an automatic clothes dryer without the free tumbling action. Examples of these are found in U.S. Pat. Nos. 3,256,616 to McGoldrick and 4,109,397 to Daily. In McGoldrick warm air from the exhaust duct of a laundry dryer is diverted into a separate shoe drying compartment mounted on the dryer. Disadvantageously, this apparatus and method requires construction of a separate drying compartment for the shoes and a damper or a valve in the exhaust duct of the dryer.

Daily discloses a covered basket 34 that is mounted within the drying drum so as to be positioned about the rotational axis of the drum. Articles held in the basket are prevented from freely tumbling against the wall of the dryer drum. It should be appreciated, however, that the basket by extending about the rotational axis of the dryer drum prevents in any way the effective tumbling of other articles outside the basket within the dryer drum. As such, the basket in Daily can only be used to dry shoes separately from clothes and other articles appropriate for tumble drying.

It, of course, would be desirable to avoid the inconvenience of having to run independent drying cycles for the regular dryer load and the shoes in the non-tumbling basket. This is not just a waste of the operator's valuable time. It is also an inefficient use of energy since the dryer circulates heated air with the capacity of drying both the regular load and the shoes in the non-tumble basket during any single drying cycle.

SUMMARY OF THE INVENTION

Accordingly, a primary object of the present invention is to provide a lightweight apparatus for drying shoes in an automatic clothes dryer of simple, low cost construction overcoming the above-described limitations and disadvantages of the prior art.

Another object of the present invention is to provide an adjustable apparatus that may be easily utilized for the tumble free drying of shoes in a rotating drum of an automatic dryer. Thus, noise is reduced and any possibility of damage to the shoes and dryer drum from tumbling against the drum wall is eliminated.

An additional object of the present invention is to provide a shoe drying apparatus that does not extend across the central portion of the drying drum but instead rests along the sidewall of the drum so as not to interfere with the normal tumbling action of other clothes in the dryer.

Still another object of the present invention is to provide a shoe drying apparatus that holds a shoe adjacent the wall of the drying drum so that it extends toward the middle of the drum for maximal contact with the circulating drying air currents.

A further object of the present invention is the provision of a simple, safe and effective method of drying shoes in an automatic dryer.

Additional objects, advantages, and other novel features of the invention will be set forth in part in the description that follows and in part will become to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus is provided for drying shoes in an automatic clothes dryer equipped with a rotating drum. The apparatus includes a frame member having a mounting surface for engaging and supporting a shoe. The mounting surface is substantially planar and the frame member may, for example, be in the form of a plate that engages the sole of the shoe. Means are connected to the frame member for releasably fastening the shoe to the frame member. Also connected to the frame member are means for securely attaching the frame member and connected shoe to an inner circumferential surface of the dryer drum.

Advantageously, when attached, the apparatus and shoe extend in a substantially radial orientation from the wall of the drum. In this orientation, the shoe is held so as to project into the central portion of the drum for maximum contact with the circulating drying air currents. This results in more efficient drying of the shoe thereby reducing the overall time during which the dryer must be operated and saving energy. Further, as should be appreciated, since the apparatus and shoe are radially oriented any interference with the tumbling action of other clothes in the dryer is minimized. In fact, when the apparatus and shoe are positioned on the wall of the dryer drum directly behind one of the dryer paddles that promotes tumbling of the clothes, the tumbling action remains essentially unaltered.

Preferably, the frame member includes a lip at least at one end but possibly at both ends. Each lip projects above the mounting surface to engage the heel or toe of the shoe and prevent any possibility of the shoe sliding from the mounting surface during drying.

A pair of straps may be used to fasten the shoe to the frame member and hold the heel of the shoe snugly against one lip. Preferably the straps are adjustable so that they may be extended around the mounting surface of the frame member and the shoe to snugly hold the shoe in place regardless of its size or shape. In order to achieve this result, each strap may include ends that are connected together by hook and loop fasteners. An example of this type of fastener is sold under the well-known trademark Velcro.

An important aspect of the present invention deals with the secure attachment of the shoe and frame member to the rotating drum of the dryer. This attachment must be able to maintain the apparatus and connected shoe in position on the drum wall despite the centrifugal forces produced by the rotating drum as well as the beating and pull of other clothes tumbling within the dryer. In order to achieve this result, strong magnets are utilized to attach the frame member to the metal dryer drum. These magnets are securely mounted to the frame member within a channel that is attached to in the frame member on the side of the frame member opposite the mounting surface. Preferably, the magnet produces substantially 25 lbs. force to hold the apparatus and connected shoe in proper position. Advantageously, such a magnet even allows heavy shoes to be dried in the dryer utilizing the present apparatus. For example, it is possible to dry hightop tennis shoes that are soaking wet and made even heavier by the water retained in the fabric.

In order to concentrate the magnetic attracting force between the frame member and the dryer drum, the channel may be constructed of ferromagnetic material. The channel also includes lips extending outwardly past the magnets on each side. These lips act as opposite poles and serve to concentrate the magnetic field lines thereby increasing the force of attraction between the apparatus and the metal dryer drum.

So that the drying apparatus may be further adapted to securely retain different size shoes to the mounting surface, two individual slots are provided between the channel and the frame member. These slots each receive one fastening strap as described above. The first slot is substantially equal in width to the fastening strap. Thus, the strap received in this slot is maintained in a single position relative to the frame member and shoe mounting surface. The second slot is elongated to allow infinite adjustment of the position of the strap received therein. More specifically, the strap can slide along the elongated slot and be adjusted relative to the first strap to securely anchor any size shoe to the frame member. Advantageously, this reduces the cost of manufacture of the apparatus of the present invention since only one size frame member needs to be produced to retain any size shoe in position in the dryer drum. Further, this feature appeals to the consumer since one of the devices may be used to dry the shoes of a number of different members of the family.

In accordance with yet another aspect of the present invention, a method of drying shoes in an automatic clothes dryer is provided. The method includes the step of fastening a shoe to a shoe mounting surface of a shoe drying apparatus. Then, by attaching the apparatus and shoe to the inner surface of the dryer drum wall, the shoe may be safely dried along with other clothes that tumble freely in the dryer. Advantageously, since the shoe is securely attached to the drum wall, the damage that could be caused by a tumbling shoe to the shoe, the dryer and the clothes in the dryer is substantially eliminated. Further, by positioning the apparatus and shoe directly behind the paddle of the dryer drum, the normal tumbling action provided to the other clothes in the dryer is not interfered with or adversely affected. Thus, these clothes continue to dry efficiently. Once drying is completed, the apparatus is easily removed from the dryer. Where attached by magnets, the apparatus is simply "snapped" free from the drum wall. The shoe may then be easily released from the apparatus by pulling open the fastened Velcro straps.

Still other objects of the present invention will become readily apparent to those skilled in this art from the following description wherein there is shown and described a preferred embodiment of this invention simply by way of illustration of one of the modes best suited to carry out the invention. As it will be realized, the invention is capable of other and different embodiments and its several details are capable of modifications in various, obvious aspects all without departing from the invention. Accordingly, the drawings and descriptions will be regarded as illustrative in nature and not as descriptive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
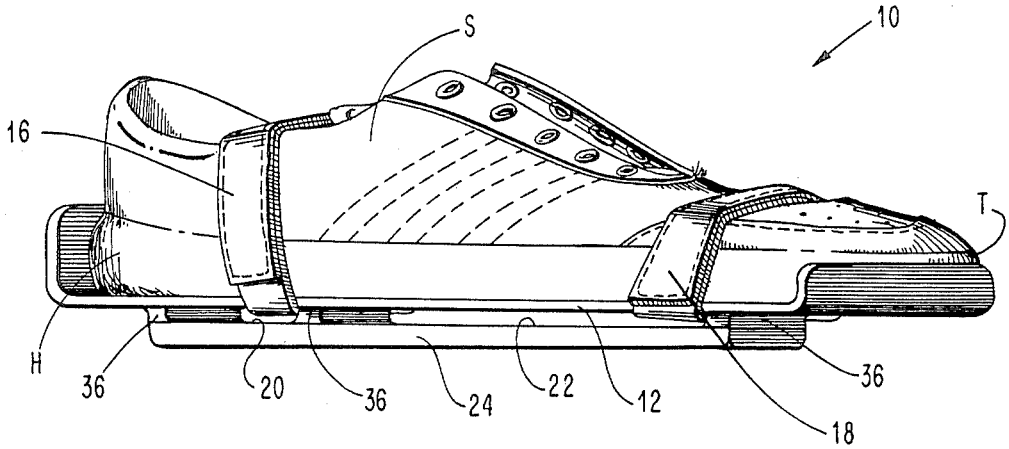
FIG. 1 is a perspective view of the shoe drying device of the present invention holding a shoe.
Figure 3:
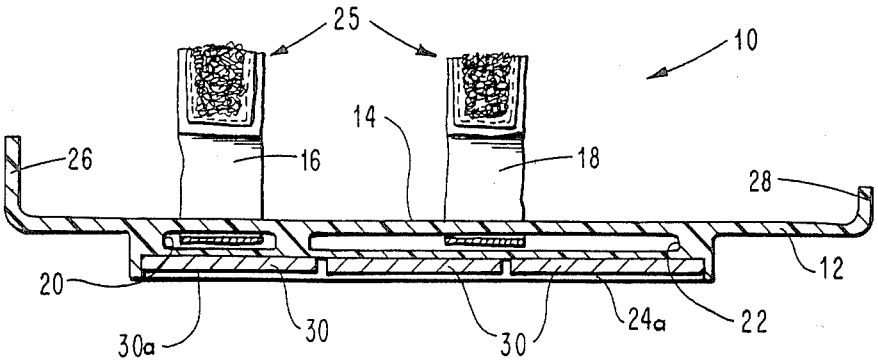
FIG. 3 is a longitudinal cross-sectional view of the apparatus of the present invention.

Reference is now made to the drawing figures showing two embodiments of the apparatus 10 of the present invention for drying shoes in an automatic clothes dryer equipped with a rotating drum. As best shown in FIGS. 1 and 3 the apparatus 10 includes a substantially planar frame member 12. A flat mounting surface 14 along the top face of the frame member 12 engages and supports a shoe S for drying.

Figure 5:
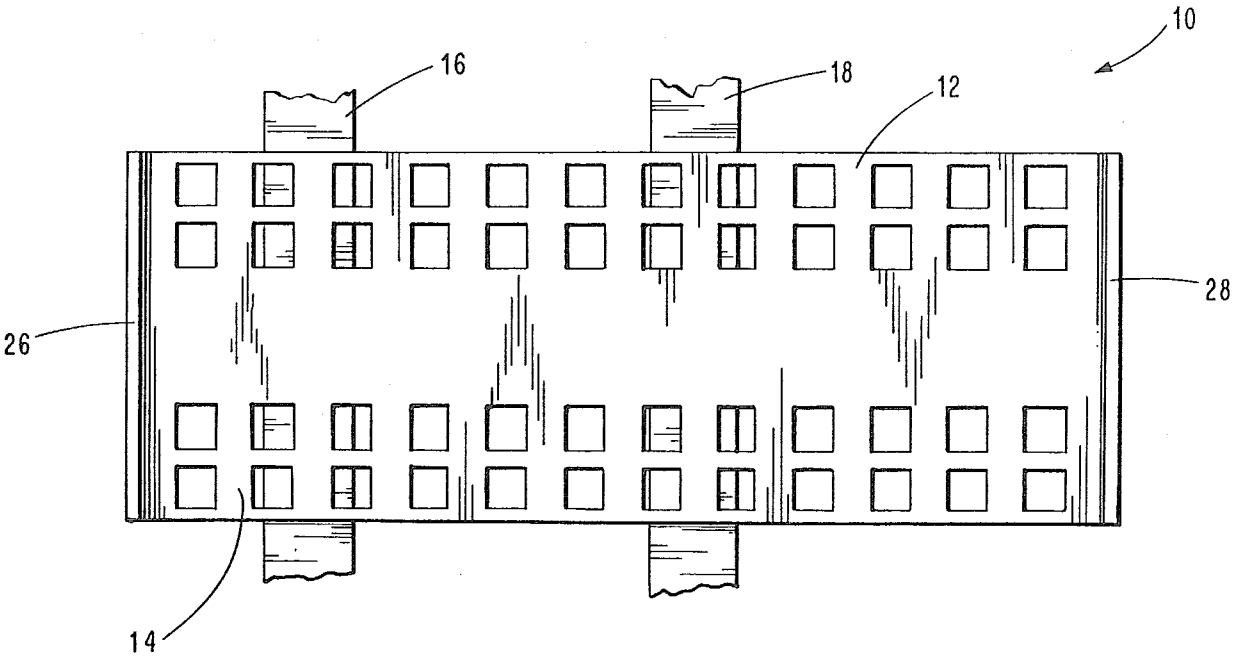
FIG. 5 is a top plan view showing a shoe mounting surface with grid structure.

Preferably, the frame member 12 is inexpensively constructed of molded plastic capable of withstanding the temperatures reached during the drying cycle. As shown in FIG. 5, the plastic may be formed in a grid structure or configuration to provide added rigidity to the frame member 12. Advantageously, the grid structure also serves to increase the friction between the sole of the shoe S and the mounting surface 14 so as to reduce the possibility of the shoe slipping from the surface during drying.

Two straps 16, 18 are provided for securely anchoring the shoe S on the mounting surface 14. Each strap 16, 18 passes through a slot 20, 22 formed between the frame member 12 and a channel 24 the function of which will be discussed in detail below. An adjustable fastener 25 at the end of each strap 16, 18 allows the straps to be used to securely tighten the shoe S down against the mounting surface 14 to maintain it in position. A hook and loop fastener of the type available under the Velcro trademark is shown in the drawing. It should be recognized, however, that any other type of fastener 25 appropriate for this purpose may be utilized.

In order to further ensure the secure positioning of the shoe S upon the mounting surface 14 during the drying cycle, each end of the frame member 12 is provided with a lip 26, 28. As shown in FIGS. 1 and 3, the lips 26, 28 each project upwardly from the mounting surface 14 at an angle of substantially 90°. The shoe S is positioned upon the mounting surface 14 with the heel H butting the lip 26. Each strap 16, 18 is then tightly wrapped over the shoe S and the velcro fastener 25 fastened. The tight straps 16, 18 serve to retain the shoe S on the mounting surface 14 firmly butted against the lip 26.

The lip 28 at the front end of the frame 12 also prevents the shoes from slipping. Depending on the size of the shoe S, the lip 28 may engage the tip of the toe T of the shoe so as to prevent the shoe from sliding away from the lip 26 (see FIG. 1). Alternatively, the lip 28 may engage the sole of the shoe S just beneath the toe T. In this instance, when the strap 18 is tightened to press the shoe against the mounting surface 14, the edge of the lip 28 projects into the sole so as to provide positive engagement to resist possible slipping. Thus, it should be appreciated that together the grid configuration of the mounting surface 14, the lips 26, 28 and the straps 16, 18 effectively eliminate any possibility of the shoe S shifting on or slipping from the apparatus 10 even when engaged by clothes tumbling freely in the dryer.

Figure 4:
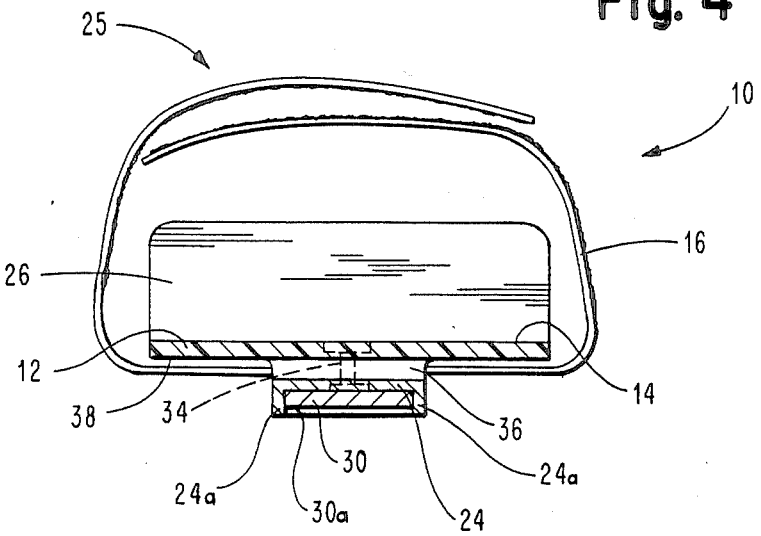
FIG. 4 is a transverse cross-sectional view of the present invention.

The apparatus 10 is mounted or attached to the drum D of an automatic Dryer A by means of powerful magnets 30. The magnets provide approximately 25 lbs. of force to securely hold the apparatus 10 and attached shoe S to the wall of the drum D during the drying cycle. The magnets 30 are securely mounted to the frame member 12 by adhesive or other means within the channel 24. In order to reduce production costs, this channel 24 may be constructed of plastic and integrally formed with the remainder of the frame member 12 (see FIG. 3). Alternatively, as shown in FIGS. 1 and 4, the channel 24 may be constructed of ferromagnetic material such as steel.

Figure 2:
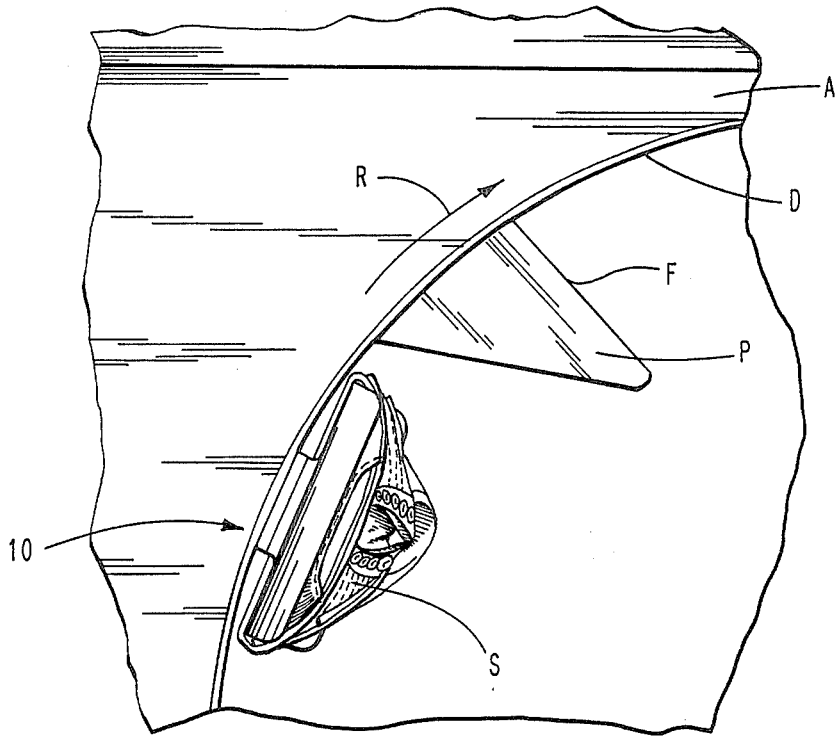
FIG. 2 is a broken-away, schematical representation showing the device of the present invention attached to the drum of an automatic clothes dryer directly behind one of the clothes paddles of the drum.

Advantageously, the steel channel 24 includes sidewalls **24*a* that extend past the engaging faces 30*a* of the magnets 30. These sidewalls 24*a* act as poles that concentrate the magnetic field lines of the magnets 30. Thus, the steel channel 24 increases the attractive force between the apparatus 10 of the present invention and the wall of the dryer drum D when mounted as shown in FIG. 2. As a result, the apparatus 10** of the present invention may be used to dry heavy shoes such as hiking boots and still maintain them in position along the wall of the drum D during the drying cycle.

The steel channel 24 is mounted to the frame member 12 by means of rivets 34. Blocks 36 molded on the bottom face 38 of the frame member 12 receive and securely anchor the rivets 34. The blocks 36 also serve to space the channel 24 from the frame member 12 with the slots 20, 22 formed therebetween.

In either of the embodiments shown in FIGS. 1 or 3, the slot 20 is substantially the width of the strap 16. The slot 20 thereby serves to maintain the position of the strap 16 relative to the mounting surface 14. More particularly, the strap 16 is positioned to be drawn tight around the foot receiving portion of the shoe S and maintain the heel H of the shoe against the lip 26.

In contrast to the slot 20, the slot 22 is elongated. Thus, the strap 18 may be moved along the slot 22 longitudinally with respect to the mounting surface 14. As a result, the strap 18 may be positioned to be drawn tight around the upper of the shoe S near the toe T. In this way, the relative positions of the two straps 16, 18 may be adjusted to securely engage any particular size of shoe S and used to securely mount the shoe to the frame 12.

After securely fastening the shoe S to the frame member 12, the frame member is attached to the metal dryer drum D with the magnets 30. The shoe S is then effectively held by magnetic attractive force in position against the wall of the dryer drum D during the drying cycle. Advantageously, with the shoe S securely held in this position, the shoe projects radially toward the center of the dryer for maximum contact with the warm air circulating through the dryer. Further, the shoe S is prevented from tumbling and bouncing against the dryer drum D as the drum rotates. Consequently, possible damage to the shoe S and dryer drum D from this jarring action is prevented.

As shown, the drum D may also include at least one paddle P for tumbling the clothes in the dryer as the drum rotates. Preferably, the apparatus 10 and shoe S are attached to the drum D adjacent the paddle P. More particularly, the apparatus 10 is attached directly behind the paddle P in relation to its direction of rotation (note action arrow R). In this position, the apparatus 10 and attached shoe S do not interfere with the normal tumbling action provided to other clothes in the dryer A by the paddle P. Thus, the effective and efficient drying of other clothes in the dryer A with the shoe and apparatus is maintained. Further, it should be appreciated that the leading face F of paddle P effectively deflects clothes from engaging the apparatus 10 and shoe S. Thus, any possibility of clothes wrapping around and pulling the apparatus 10 free from the drum D is substantially eliminated.

In summary, numerous benefits have been described which result from employing the concepts of the present invention. The shoe drying apparatus 10 is inexpensive to construct and easy to use. The fasteners 25 allow easy attaching/detaching of the shoe S to and from the apparatus. The magnets 30 allow easy attaching-/detaching of the apparatus to and from the dryer drum D. Despite this feature, however, the magnets 30 are strong enough to securely and effectively maintain the apparatus 10 and shoe S in position along the wall of the dryer drum D during the drying cycle, even when clothes are tumbling in the drum for simultaneous drying. Thus, the noise and potential damage produced by the tumbling and bouncing of shoes S within a dryer A is eliminated.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, in order to maintain the balance of the rotating dryer drum when drying heavy shoes such as hiking boots, it is important to mount one apparatus and shoe at each of two diametrically opposed points within the dryer drum.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

We claim:

1. An apparatus for drying shoes in an automatic clothes dryer equipped with a rotating drum having a clothes tumbling paddle, comprising:

a frame member including a mounting surface for engaging and supporting a shoe;

means connected to said frame member for releasably fastening said shoe to said frame member; and means connected to said frame member for securely attached said frame member and shoe to an inner circumferential surface of said dryer drum in a substantially radial orientation; said apparatus being further adapted for positioning directly behind a paddle of said rotating drum so as to provide more efficient drying of said shoe while minimizing interference of said apparatus and shoe with tumbling action of other clothes in said dryer.

2. The apparatus recited in claim 1, wherein said mounting surface is substantially planar and engages the sole of said shoe.

3. The apparatus recited in claim 2, further including a lip at at least one end of said frame member, said lip projecting above said mounting surface so as to prevent said shoe from sliding from said surface.

4. The apparatus recited in claim 1, wherein said fastening means are a pair of straps.

5. The apparatus recited in claim 4, wherein each of said straps is fixed together by means of a hook and loop fastener.

6. The apparatus recited in claim 1, further including a channel attached to said frame member on a face opposite said mounting surface, said attaching means being mounted in said channel.

7. The apparatus recited in claim 6, wherein said attaching means is a magnet.

8. The apparatus recited in claim 7, wherein said magnet provides substantially 25 lbs. of force.

9. The apparatus of claim 7, wherein said channel is constructed of ferromagnetic material and includes sidewalls extending past an engaging face of said magnet so as to concentrate the force of said magnet.

10. The apparatus of claim 6, including a first slot provided between said channel and said mounting surface on said frame member for the receipt of a first fastening strap, said first slot being substantially equal in width to said fastening strap and a second elongated slot provided between said channel and said mounting surface on said frame member for the receipt of a second fastening strap, said second strap being slidably received in said elongated slot for adjustability so as to securely retain any of various sizes of a shoe to said frame member.

11. An apparatus for drying shoes in an automatic clothes dryer equipped with a rotating drum, comprising:

a frame member including a mounting surface for engaging and supporting a shoe and a channel on a face of said frame member opposite said mounting surface;

means connected to said frame member for releasably fastening said shoe to said frame member, said fastening means extending substantially around said mounting surface and said shoe; and means mounted in said channel on said frame member for securely attaching said frame member to said rotating drum of said dryer.

12. The apparatus recited in claim 11, wherein said mounting surface is substantially planar and engages the sole of said shoe.

13. The apparatus recited in claim 12, further including a lip at at least one end of said frame member, said lip projecting above said mounting surface so as to prevent said shoe from sliding from said surface.

14. The apparatus recited in claim 11, wherein said fastening means are a pair of straps.

15. The apparatus recited in claim 14, wherein each of said straps is fixed together by means of a hook and loop fastener.

16. The apparatus of claim 11, wherein said attaching means is a magnet.

17. The apparatus of claim 16, wherein said magnet provides substantially 25 lbs. of force.

18. The apparatus of claim 16, wherein said channel is constructed of ferromagnetic material and includes sidewalls extending past an engaging face of said magnet so as to concentrate the force of said magnet.

19. The apparatus of claim 11, including a first slot between said channel and said mounting surface on said frame member for the receipt of a first fastening strap, said first slot being substantially equal in width to said fastening strap and a second elongated slot provided between said channel and said mounting surface on said frame member for the receipt of a second fastening strap, said second strap being slidably received in said elongated slot for adjustability so as to securely retain any of various sizes of a shoe to said frame member.

20. A method of drying shoes in an automatic clothes dryer having a rotating drum with paddles by utilizing a shoe drying apparatus comprising the steps of:

fastening a shoe to a shoe mounting surface of said shoe drying apparatus, and releasably attaching the shoe drying apparatus and shoe securely to an inner circumferential surface of said drum so as to extend in a substantially radial orientation for more efficient drying of said shoe while minimizing interference of said apparatus and shoe with tumbling action of other clothes in said dryer.

21. The method of claim 20, including the additional step of positioning said apparatus and shoe directly behind a paddle of said dryer drum.

* * * * *

UNITED STATES PATENT OFFICE

CERTIFICATE OF CORRECTION

Patent No. 4,702,016 Dated October 27, 1987

Inventor(s) Samuel H. Grigsby; Beverly A. Grigsby

It is certified that error appears in the above-identified patent and that said Letters Patent are hereby corrected as shown below:

In Claim 1, column 8, line 4, change "attached" to --attaching--.

Signed and Sealed this

Thirtieth Day of August, 1988

*Attest:*

DONALD J. QUIGG

*Attesting Officer*

*Commissioner of Patents and Trademarks*